US009113668B2

(12) United States Patent
Lembo James et al.

(10) Patent No.: US 9,113,668 B2
(45) Date of Patent: Aug. 25, 2015

(54) SHOULDER STRAP RETAINER FOR GARMENTS

(75) Inventors: Rosemarie Lembo James, Stuart, FL (US); Michael Cristoforo, Palm City, FL (US)

(73) Assignee: Strap Genie LLC, Stuart, FL (US)

( * ) Notice: Subject to any disclaimer, the term of this patent is extended or adjusted under 35 U.S.C. 154(b) by 675 days.

(21) Appl. No.: 13/463,407

(22) Filed: May 3, 2012

(65) Prior Publication Data

US 2012/0278974 A1 Nov. 8, 2012

Related U.S. Application Data

(60) Provisional application No. 61/481,794, filed on May 3, 2011.

(51) Int. Cl.
*A41F 15/02* (2006.01)
*A41F 1/00* (2006.01)

(52) U.S. Cl.
CPC ..... *A41F 15/02* (2013.01); *A41F 1/002* (2013.01)

(58) Field of Classification Search
CPC ..... A41D 15/02; A41D 15/002
USPC ..... 2/563, 341, 303; 24/460, 459, 336
See application file for complete search history.

(56) References Cited

U.S. PATENT DOCUMENTS

| | | | | | |
|---|---|---|---|---|---|
| 378,394 | A | * | 2/1888 | Haskins | 2/460 |
| 1,489,731 | A | | 4/1924 | Baldwin | |
| 1,544,303 | A | * | 6/1925 | Fellows | 24/341 |
| 1,589,228 | A | * | 6/1926 | Robb | 24/532 |
| 1,593,776 | A | * | 7/1926 | Raymond | 24/532 |
| 2,015,113 | A | * | 9/1935 | Johnson | 24/304 |
| 2,046,589 | A | * | 7/1936 | Stader | 24/706.1 |
| 2,049,660 | A | * | 8/1936 | Patten | 24/563 |
| 2,551,255 | A | * | 5/1951 | Engel | 2/460 |
| 2,633,573 | A | * | 4/1953 | Sanders | 2/460 |
| 2,643,380 | A | * | 6/1953 | Blair | 2/460 |
| 4,575,874 | A | * | 3/1986 | Johnson | 2/460 |
| 4,704,745 | A | * | 11/1987 | Reaver | 2/268 |
| 4,764,988 | A | * | 8/1988 | Reaver | 2/268 |
| 4,953,233 | A | * | 9/1990 | Moshier | 2/268 |
| 5,060,348 | A | * | 10/1991 | Moshier | 24/442 |
| 5,308,278 | A | | 5/1994 | Huang | |
| 5,309,608 | A | | 5/1994 | Lucas | |
| 5,590,545 | A | * | 1/1997 | Norris | 24/563 |
| 5,803,792 | A | * | 9/1998 | Roush et al. | 450/86 |
| 5,913,413 | A | | 6/1999 | Huyck | |
| 5,914,166 | A | | 6/1999 | Le | |
| 5,992,176 | A | | 11/1999 | Arbogast | |

(Continued)

*Primary Examiner* — Richale Quinn
(74) *Attorney, Agent, or Firm* — McHale & Slavin, P.A.

(57) ABSTRACT

The present invention relates to a shoulder strap retainer for garments, and more particularly to an undergarment strap retention device for retaining a shoulder strap of an undergarment beneath a shoulder strap of an outer garment. Retention of a strap of an undergarment, such as a bra, beneath the shoulder strap of an outer garment is accomplished by a pair of members which are magnetically attracted to each other. One of the members, an anchor assembly, is secured to a strap of an undergarment. The strap of the outer garment is positioned above and adjacent to the undergarment with the inner strap hidden from view. A decorative base plate is placed against the outer surface of the outer garment to engage the magnetic field produced by magnets positioned within the anchor assembly so the magnetic field pulls against the base plate to sandwich the cloth of the outer garment.

16 Claims, 9 Drawing Sheets

(56) References Cited

U.S. PATENT DOCUMENTS

| | | | | |
|---|---|---|---|---|
| 5,996,116 | A * | 12/1999 | Tate | 2/12 |
| 6,135,852 | A | 10/2000 | Young | |
| 6,155,906 | A | 12/2000 | May | |
| 6,206,752 | B1 | 3/2001 | Fagin et al. | |
| 6,253,385 | B1 * | 7/2001 | Fields | 2/246 |
| 6,357,642 | B1 * | 3/2002 | Marchessault et al. | 224/269 |
| 6,688,505 | B1 * | 2/2004 | Bradley et al. | 224/230 |
| 6,715,186 | B1 | 4/2004 | Huang | |
| 6,827,628 | B2 | 12/2004 | Kaye et al. | |
| 7,404,215 | B2 * | 7/2008 | Allen | 2/232 |
| 7,819,721 | B1 | 10/2010 | Messier | |
| 8,869,314 | B2 * | 10/2014 | Peper et al. | 2/336 |
| 2003/0029006 | A1 * | 2/2003 | Pelt et al. | 24/303 |
| 2006/0282993 | A1 * | 12/2006 | Dietz | 24/303 |
| 2010/0122438 | A1 * | 5/2010 | Amron | 24/303 |

* cited by examiner

SHOULDER STRAP RETAINER FOR GARMENTS

CROSS REFERENCE TO RELATED APPLICATIONS

This application is a Continuation In Part of U.S. Provisional Application No. 61/481,794, filed May 3, 2011, entitled "Shoulder Strap Retainer for Undergarments", the contents of which are incorporated herein in their entirety.

FIELD OF THE INVENTION

The present invention relates to a device for preventing movement of an article of clothing with respect to another article of clothing; and more particularly to a device for confining the shoulder strap of an undergarment upon the user's shoulder and under the shoulder strap of an outer garment.

BACKGROUND OF THE INVENTION

It is not uncommon for the straps of foundation garments, such as those of a brassiere or camisole, to slide off the shoulder of the wearer. These straps, when exposed from under the outer garments, become a source of embarrassment. This is particularly true when the color of the undergarment is different from the color of the outer garment; for example, when the undergarment is black and the outer garment is white or a very pale color. Additionally, if the straps slide down to the upper arm, they will restrict the arm movements of the wearer and become a source of discomfort. These issues are particularly prevalent when the foundation garment is worn under a strapped outer garment that has a wide and/or deep neck opening such as a sleeveless sweater, blouse, tank top or the like. Women frequently adjust their garments under such circumstances in an attempt to conceal the brassiere straps. However, the straps are prone to coming into view despite efforts to conceal them.

Accordingly, there is a need for a device capable of retaining the straps of the foundation garments on the shoulder of the wearer and keeping them under the outer garment. Such a device should be small and thin so it can be easily hidden under outer garments of different styles. The device should also be easily engaged so as not to become a hassle for the wearer during her daily dressing routine. Ideally, the device should be a stand-alone type, which does not have to be permanently attached to a garment, so that one device could be used for many different garments. Furthermore, the device should be modifiable in color and style to allow the user to match the device to her style and color of clothing for a particular day or event. The device must also be readily releasable from the undergarment so as to permit the wearer to remove the outer garment without the difficulty of having to remove the undergarment. The device should also lend itself to modern manufacturing techniques for cost control and to allow the device to blend with modern clothing and styles.

DESCRIPTION OF THE PRIOR ART

Various devices in the past have been designed to keep undergarments from view or to maintain the straps of undergarments in alignment.

U.S. Pat. No. 1,544,303 discloses a Lingerie Clasp. The device includes a clasp member and auxiliary plate member. The plate member includes a pair of outwardly extending snap members and is constructed to be sewn into the shoulder portion of an outer garment. The clasp member is constructed from a piece of flat metal bent into a flattened loop similar in shape to a safety pin having a latch at the open end. In operation, the auxiliary member is sewn into an outer garment. The clasp is secured around the inner garment shoulder strap and thereafter attached to the auxiliary member via the snaps.

U.S. Pat. No. 2,046,589 discloses a shoulder strap holder. The holder is formed from a continuous piece of wire having an upper portion for securing the shoulder portion of the outer garment, and a lower portion for securing the shoulder strap.

U.S. Pat. No. 4,704,745 discloses a fastener device attached to the shoulder strap of a foundation garment, such as a brassiere, for securing the undersurface of an overlying outer garment worn over the shoulder straps to conceal the shoulder strap from view. The device is in the form of a fastener strip having a top surface covered with hook and loop (Velcro). The hook portion is exposed to snag the inner surface of the outer garment. U.S. Pat. Nos. 1,489,731; 1,589,228; 4,764,988; 4,953,233; 5,060,348; 5,590,545 and 5,914,166 illustrate similar devices.

U.S. Pat. No. 2,049,660 discloses a Shoulder Strap Retaining Device. The device is formed from a thin narrow strip of metal material having a medial body portion and opposite inwardly folded ends overlapping in a spaced parallel relationship.

U.S. Pat. No. 2,643,380 discloses a Shoulder Strap Holder. The strap holder is a symmetrical channel-like member and has foam padding bonded to the underside thereof. The device is formed from plastic which is readily deformable, but sufficiently rigid to retain its shape. U.S. Pat. Nos. 1,593,776; 2,015,113; 2,633,573; 5,308,278; 5,309,608; 5,803,792; 5,913,413; 6,135,852; 6,155,906 and 6,827,628 illustrate similar devices.

U.S. Pat. No. 6,206,752 B1 discloses non-woven, non-shiny, and substantially transparent clothing straps for use with apparel worn under loosely fitting sleeveless outer garments, undergarments used with sheer outer clothing, or outer clothing having narrow shoulder straps or cutouts therein which would otherwise readily reveal undergarment straps, and other apparel to give a strapless illusion to it. The straps are made from flexible, resilient, but non-stretchable material and could be permanently attached to a garment or made to be easily and readily detached from it. Also, a short stretchable extension could be inserted between one end of the strap and the garment to which it is attached to help the strap resist twisting and lay in an essentially flat, more comfortable and discrete position during use.

U.S. Pat. No. 6,715,186 discloses a charm chain comprised of an ornamental chain in a selected shape, multiple snaps and a lining band; snaps being respectively fixed to both ends of the ornamental chain and retain the lining band at the bottom of the ornamental chain for the charm chain to be adapted to a string bikini, a bra, a strap or any other accessories for ornamental purpose and safe use since the ornamental chain is prevented from directly contacting one's skin by means of the lining band.

U.S. Pat. No. 5,992,176 discloses a jewelry item having a top member pivotally joined by a hinge to a lower base member used to retain a handbag's shoulder strap in place to the clothing of a user. The top and base members are curved lengthwise to resemble the natural curvature of a user's shoulder. A latch on the top can engage a mating member on the base member to lock the top and base members together when closed. A fastener on the base can attach the jewelry item to the clothing of a user at their shoulder. Several different designs and materials are disclosed for the exposed upper surface of the top member to exhibit and resemble a fine piece of jewelry. This jewelry item may be worn alone or used to retain the shoulder strap of a handbag to a user.

U.S. Pat. No. 7,819,721 discloses a decorative accessory which can be interchangeably secured to a variety of different items of clothing. The decorative accessory includes a strap which may be secured to an undergarment.

SUMMARY OF THE INVENTION

The present invention relates to a shoulder strap retainer for garments, and more particularly to an undergarment strap retention device for retaining a shoulder strap of an undergarment beneath a shoulder strap of an outer garment. Retention of a strap of an undergarment, such as a bra, beneath the shoulder strap of an outer garment is accomplished by a pair of members which are magnetically attracted to each other. One of the members, an anchor assembly, is secured to a strap of an undergarment in a desired position. The strap of the outer garment is positioned above and adjacent to the undergarment with the inner strap hidden from view. A decorative base plate is placed against the outer surface of the outer garment to engage the magnetic field produced by magnets positioned within the anchor assembly so that the magnetic field pulls against the base plate to sandwich the cloth of the outer garment. The use of magnets prevents the members from having to be sewn into the garments, while the magnetic attraction allows the user to position the undergarment and the base plate as desired. The magnetic attraction between the members also permits removal of the securing element without removal of the device secured to the strap. This construction also permits decorative items to be attached to the base plate which can be changed or oriented as desired by the user.

Accordingly, it is an objective of the present invention to provide a device for the retention of the straps of an undergarment beneath an outer garment.

It is a further objective of the present invention to provide a device which is readily securable to and removable from both an undergarment and an outer garment without damaging either garment.

It is still a further objective of the present invention to provide a device for securing an undergarment beneath an outer garment which can be readily adjusted after it is secured to the garments.

It is yet another objective of the present invention to provide a device which can be secured to an undergarment without damaging the undergarment.

It is a still further objective of the present invention to provide a device for securing an undergarment beneath an outer garment to which decorative accessories can be attached.

It is a still further objective of the present invention to provide a device that utilizes a magnetic field to secure an undergarment and an outer garment in a desired arrangement.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
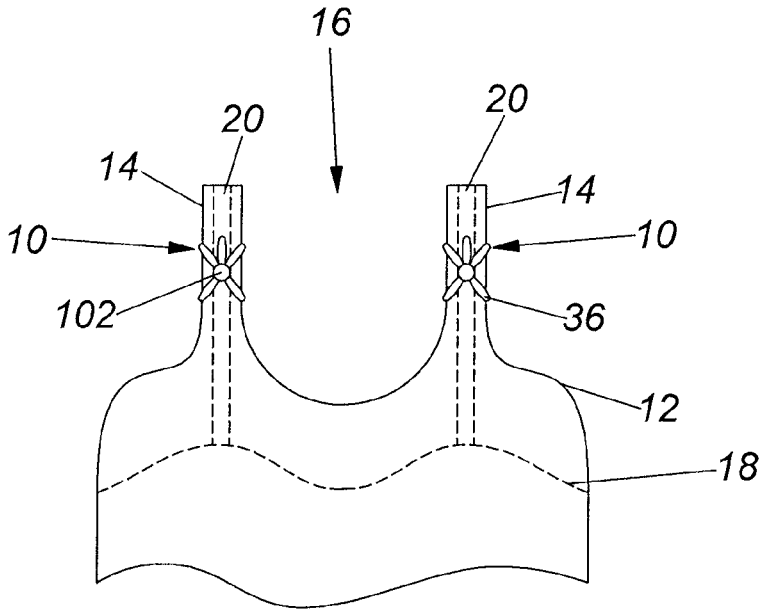
FIG. 1 is a plan view of one embodiment of the present invention illustrating the positioning of an undergarment with respect to an outer garment.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Referring to FIG. 1, the shoulder strap retainer 10 is illustrated in a position secured to an outer garment 12. The outer or over garment includes a plurality of straps 14 and a wide neckline 16. An undergarment 18 is worn beneath the outer garment 12 and also includes a plurality of straps 20. The shoulder strap retainer secures both the outer garment and the undergarment via a magnetic field to retain the straps 20 of the undergarment 18 beneath and in line with the straps 14 of the outer garment 12. This prevents the straps 20 of the undergarment from being seen by other individuals so that an individual wearing the present invention will present an attractive appearance. A decorative base plate 102 is placed against the outer surface of the outer garment 12 to engage the magnetic field produced by magnets positioned within the anchor assembly 100, secured to the strap 20 of the undergarment 18, so that the magnetic field pulls against the base plate to sandwich the cloth of the outer garment. The use of magnets prevents the members from having to be sewn into the garments, while the magnetic attraction allows the user to position the undergarment and the base plate as desired. The magnetic attraction between the members also permits removal of the securing element without removal of the device secured to the strap. This construction also permits decorative items 36 to be attached to the base plate which can be changed or oriented as desired by the user.

Figure 2:
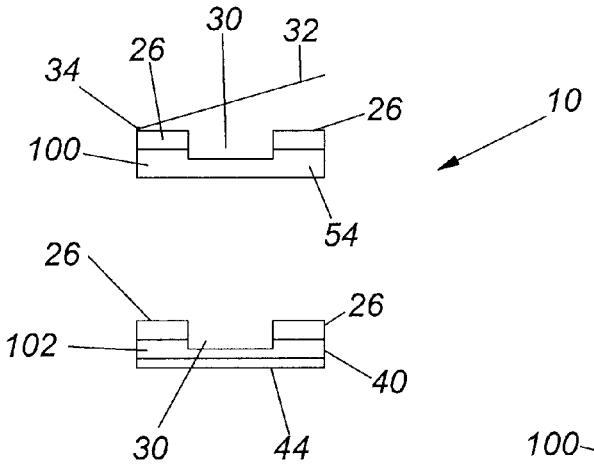
FIG. 2 is a side view of one embodiment of the present invention.

Referring to FIGS. 1 and 2, side and assembled views of one embodiment of the shoulder strap retainer 10 is illustrated. In this embodiment of the shoulder strap retainer 10 the anchor assembly 100 is securable to the strap 14 of the outer garment 12, and the strap 20 of the undergarment 18 is secured in place via the magnetic field attraction to the base plate assembly 102. The anchor assembly 100 includes at least one and preferably two magnets 26 which are mounted on an anchor plate 54. The base includes a channel 30 between the magnets 26. The channel 30 is sized to accept the strap of a garment. A metallic closure plate 32 is hingedly secured, via hinge 34, to the anchor assembly 100 for movement between an open position and a closed position. In this manner, the strap of the garment may be placed within the channel and the magnetic field from magnets 26 can retain the closure plate in the closed position. The closure plate is easily released by pulling on the closure plate 32 to overcome the magnetic pull.

A decorative item 36, such as a flower or jewelry, can be slid onto or secured to the closure plate 32. The decorative item 36 will be displayed on the outer surface of the outer garment. The decorative item 36 can be a flower, plant, animal, indicia such as letters and/or numbers, jewelry, gems, etc. The decorative item 36 is readily securable to and removable from closure plate 32 so that an individual can change the decorative item 36 depending on which item of clothing the present invention 10 is to be worn on. The decorative item 36 can also be selected to accessorize the clothing an individual is wearing.

The base plate 102 includes two metal slugs or additional magnets 26 secured to a base 40. The base 40 includes a channel 30 between the magnets 26. The length of the channel 30 is selected such that a strap 20 of an undergarment 18 will fit into the channel and substantially lay flat on an individual wearing the undergarment. The length of the base plate 102 should also be selected such that the slugs (not shown) or magnets 26 align with the magnets positioned in the anchor assembly 100. A foam pad or gel 44 is secured to a lower surface of the anchor assembly 100. The foam pad or gel will rest against the skin of an individual wearing the present invention. Therefore, the foam pad or gel should preferably be made from a hypoallergenic material.

Figure 3:
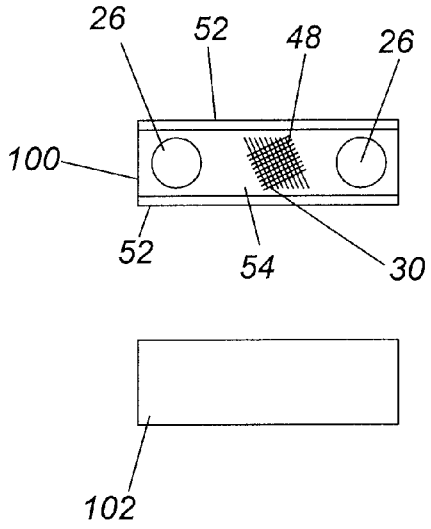
FIG. 3 is a top view of one embodiment of the present invention.
Figure 4:
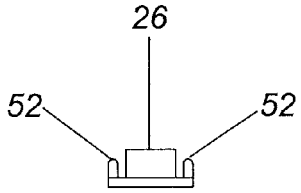
FIG. 4 is an end view of the embodiment illustrated in FIG. 3.

Referring to FIGS. 3 and 4, an alternative embodiment of the present invention is illustrated. In this embodiment, the anchor plate 54 of the anchor assembly 100 is made from an elastic fabric 48. Two magnets 26 are secured to the upper surface of the elastic fabric 48. The elastic fabric 48 enables the magnets 26 to be moved relative to each other longitudinally to allow the width of channel 30 to be altered. A plurality of stays 52 are provided to extend along the longitudinal edges of the elastic fabric 48. The stays 52 are made from a resilient material having sufficient rigidity to prevent the magnets from folding over onto each other in use. The ability of the magnets 26 to be moved relative to each other enable the anchor assembly to expand or contract for placement on undergarment straps having different widths. A decorative, or metal base plate 102 is provided that includes a width sufficient to align with the magnets 26 of the anchor assembly 100 to retain the straps of the undergarment underneath the straps of the outer garment; the base plate 102 being positioned adjacent the outer surface of the outer garment, whereby the magnetic attraction from the anchor assembly 100 pulls the base plate into engagement with the magnets 26, sandwiching the outer garment therebetween with the undergarment strap positioned between the magnets 26. This construction allows the two garments to move relative to each other while maintaining the straps in alignment and the inner strap hidden.

Figure 5:
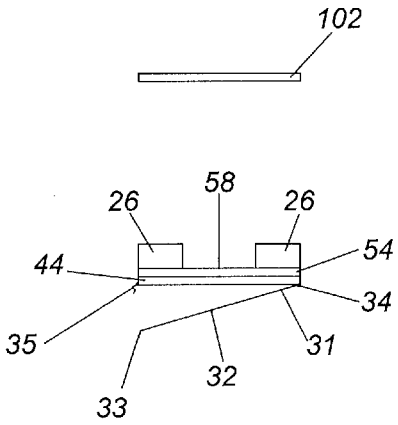
FIG. 5 is a side view of one embodiment of the present invention.

Referring to FIG. 5, an alternative embodiment of the present invention is illustrated. In this embodiment, the anchor assembly 100 includes two magnets 26 secured to an upper surface 58 of the anchor plate 54 in a spaced apart arrangement. A relatively thin layer of a hypoallergenic foam or gel 44 is secured to the lower surface of the anchor plate. A closure plate 32 is secured to the lower surface of the anchor plate via hinge 34 at a first end 31 thereof while the opposite second end 33 is releasably secured to the lower surface of anchor plate 54 via latch 35. The closure plate 32 can be releasably secured by employing a snap, a deformable member, a releasable adhesive, etc without departing from the scope of the invention. In this embodiment the strap of the undergarment is placed between the anchor plate 54 and the closure plate 32. The strap 20 of the outer garment 18 is positioned between the magnets 26, or over the magnets, and a base plate 102 is secured to the magnets to finish the assembly. Various decorations (not shown) may be secured to the base plate as desired. It should be noted that when the straps of the outer garment are placed between the magnets, the inner and outer garments are free to move relative to each other while the inner strap remains hidden.

Figure 6:
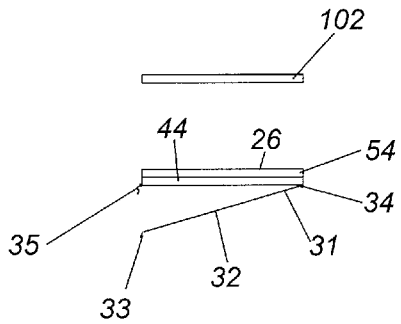
FIG. 6 is a side view of one embodiment of the present invention.

Referring to FIG. 6, an alternative embodiment of the present invention is illustrated. In this embodiment, anchor plate 54 is constructed as a magnet 26. A relatively thin layer of a hypoallergenic foam or gel 44 is secured to the lower surface of the anchor plate 54. A closure plate 32 is secured to the lower surface of the anchor plate via hinge 34 at a first end 31 thereof while the opposite second end 33 is releasably secured to the lower surface of member 54 via latch 35. The closure plate 32 can be releasably secured by employing a snap, a deformable member, a releasable adhesive, etc., without departing from the scope of the invention. In this embodiment, the strap of the undergarment is placed between the magnet 26, anchor plate 54 and the closure plate 32. The strap 14 of the outer garment 12 is positioned between the magnet 26 and the base plate 102 which is secured to the magnet to finish the assembly. Various decorations (not shown) may be secured to the base plate as desired.

Figure 7:
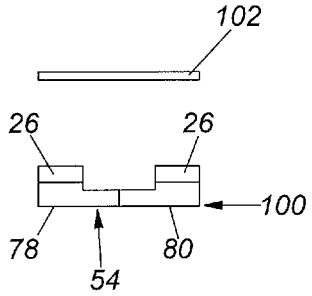
FIG. 7 is a side view of one embodiment of the present invention.

Referring to FIG. 7, an alternative embodiment of the present invention is illustrated. This embodiment is similar to the embodiment illustrated in FIG. 2, with the exception that the anchor plate 54 is constructed to include two members 78 and 80. Whereby, one of the two members 78 and 80 is slidably received within or upon the other. This construction enables the anchor plate 54 to expand and contract longitudinally. The expansion and contraction of the anchor plate 54 enables the anchor assembly 100 to accommodate undergarment straps of various widths.

Figure 8B:
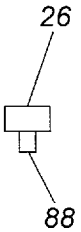
FIG. 8B is a side view of a magnet utilized in the embodiment illustrated in FIG. 8A.
Figure 8A:
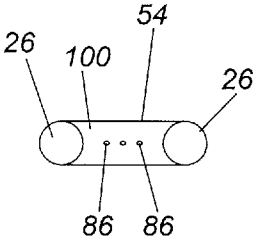
FIG. 8A is a top view of one embodiment of the present invention.

Referring to FIGS. 8A and 8B, an alternative embodiment of the present invention is illustrated. This embodiment is similar in function to the embodiment of FIG. 7. In this embodiment, the anchor plate 54 of the anchor assembly 100 includes a plurality of apertures or indentions 86. The apertures or indentions 86 are sized to frictionally cooperate with a pin 88 extending outwardly from the magnets 26. This construction permits the magnets 26 to be positioned as desired along the length of the anchor plate 54 by pushing the pin 88 into the desired aperture 86.

Figure 9:
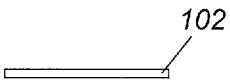
FIG. 9 is a side view of one embodiment of the present invention.
Figure 9:
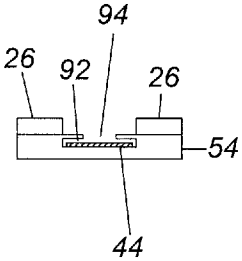

Referring to FIG. 9, an alternative embodiment of the present invention is illustrated. In this embodiment the anchor plate 54 of the anchor assembly 100 includes a slot or channel 92. The channel 92 extends along the length of the anchor plate 54 between the upper and lower surfaces and includes a slot 94. The size of the slot 94 is such that it enables a strap 20 of an undergarment 18 to be placed within the channel 92. The size of the slot 94 also prevents the strap 20 from unexpectedly coming out of the channel 92 while an individual is wearing the device. The length of the channel 92 enables the anchor plate 54 to be utilized with a plurality of straps of varying widths. A plurality of magnets 26 are secured to an upper surface of anchor plate. A base plate 102 having sufficient width to cooperate with the magnets is utilized to secure the outer garment.

Figure 10:
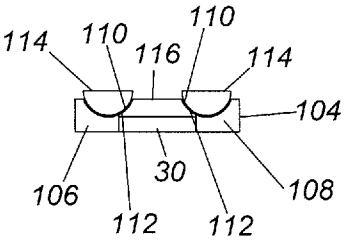
FIG. 10 is a side view of one embodiment of the present invention.
Figure 11:
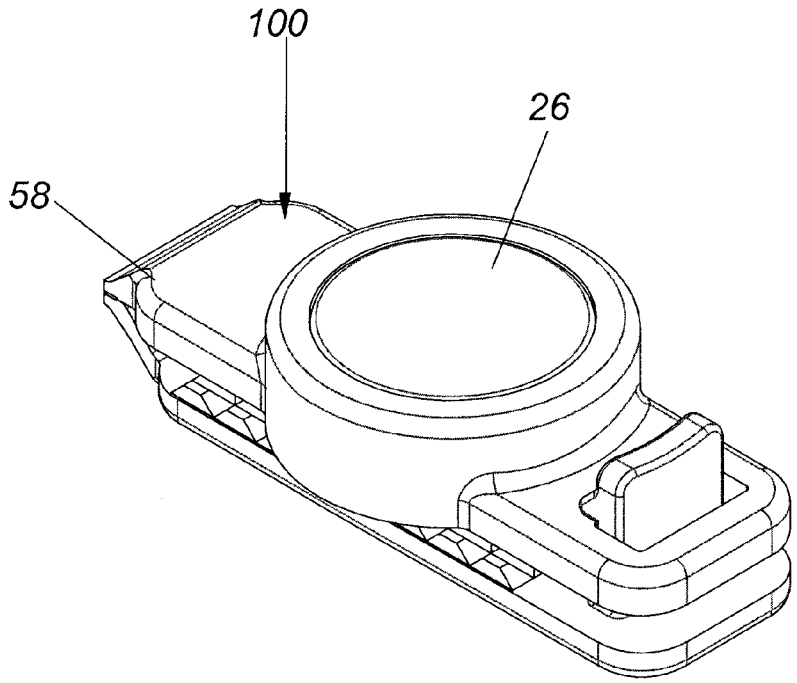
FIG. 11 is a perspective view of a preferred embodiment of the present invention.
Figure 12B:
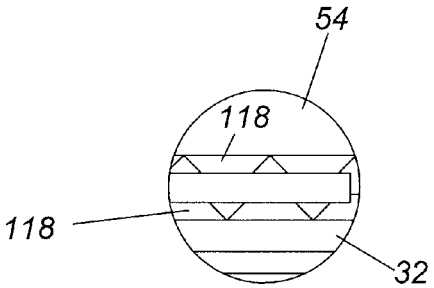
FIG. 12B is an enlarged partial view taken along lines 12B-12B of FIG. 12A.
Figure 12C:
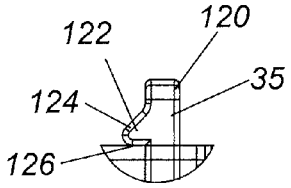
FIG. 12C is an enlarged partial view taken along lines 12C-12C of FIG. 12A.
Figure 12A:
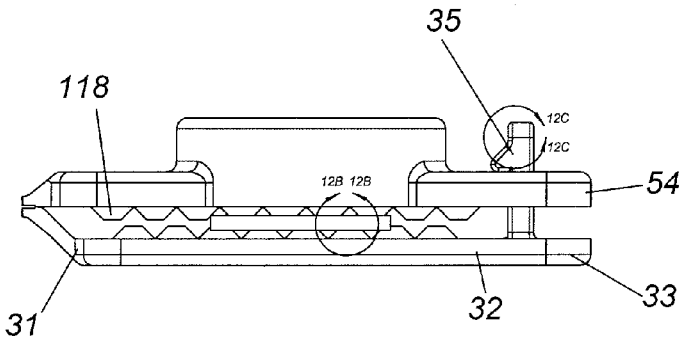
FIG. 12A is a side view of the embodiment illustrated in FIG. 11.
Figure 13:
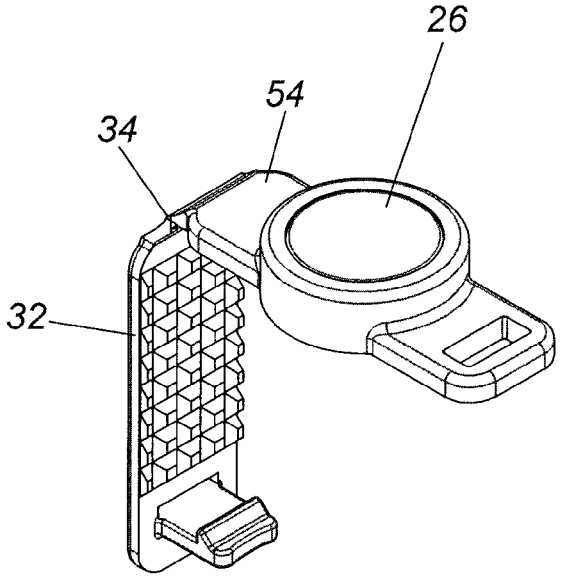
FIG. 13 is a perspective view of the embodiment illustrated in FIG. 11, illustrating the anchor portion of the device in a partially open position.
Figure 14:
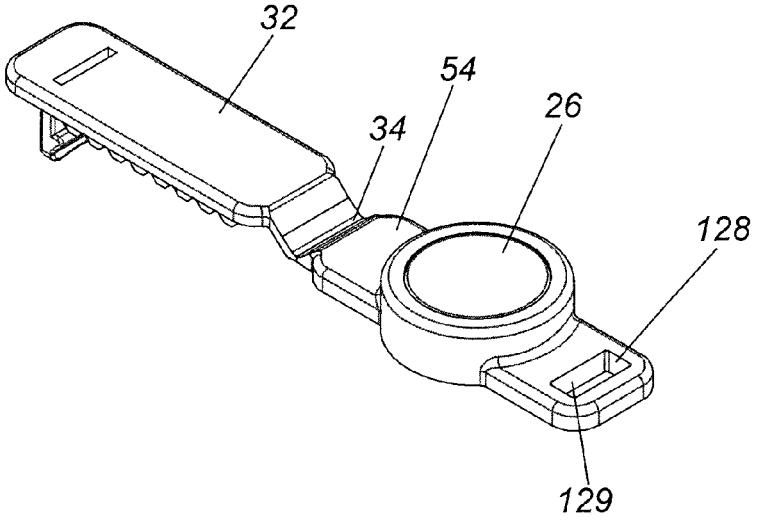
FIG. 14 is a perspective view of the embodiment illustrated in FIG. 11, illustrating the anchor portion of the device in a fully open position.
Figure 15:
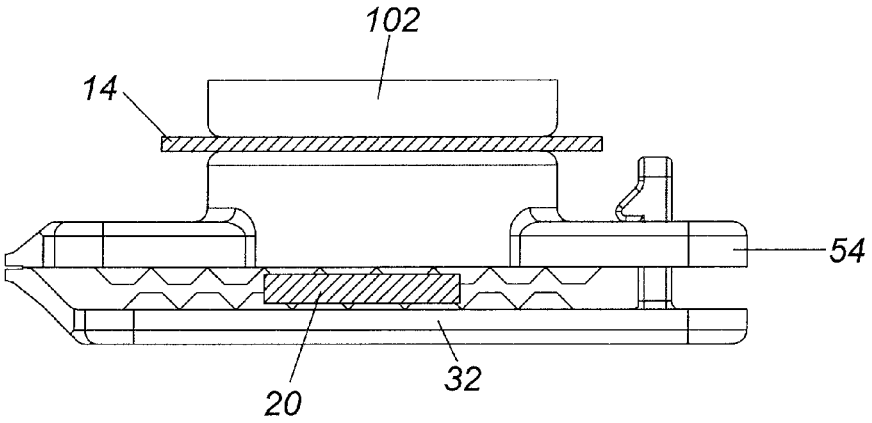
FIG. 15 is a side view, partially in section, illustrating the device of FIG. 11 in cooperation with an undergarment and an outer garment.

Referring to FIG. 10, an alternative embodiment of the present invention is illustrated. In this embodiment, a lower member 104 includes a central channel 30 formed by two stanchions 106 having spherical cavities 108 in an upper surface thereof. At least three magnets 114 and 116 are provided; the magnets 114 are constructed to include a convex spherical lower portion 110. The lower portions 110 cooperate with concave edges 112 of a central magnet 116. The central magnet 116 can be depressed downwardly to the top surface of channel 30 for insertion of an undergarment strap 20. The central magnet 116 is returned to its original position after it has been depressed by the magnetic attraction provided by magnets 114. The strap of the undergarment is now trapped and securely held within the lower member 104. A base plate 102 can then be utilized to secure the outer garment strap in place over the undergarment strap.

Referring to FIGS. 11-15, a most preferred embodiment of the present invention is illustrated. In this embodiment the anchor assembly 100 includes a single magnet 26 secured to an upper surface 58 of the anchor plate 54. A layer of gripping teeth 118 are integrally formed onto the lower surface of the anchor plate and the inner surface of the closure plate 32. A closure plate 32 is secured to the lower surface of the anchor plate via a living hinge 34 at a first end 31 thereof, while the opposite second end 33 is releasably secured to the lower surface of anchor plate 54 via latch 35. The latch 35 preferably includes a deformable member 120 having an outwardly extending catch 122. The catch includes a ramping surface 124 and catch surface 126. The latch is constructed to extend through aperture 128, whereby the deformable member 120 is caused to flex as the ramping surface engages the aperture 128 wall 129. Once the ramping surface passes the aperture wall, the deformable member springs back substantially to its original position to cause the catch surface 126 to engage the upper surface 58 of the anchor plate 54. Release requires the deformable member to be flexed sufficiently to allow the catch to be released. In the preferred embodiment, the anchor plate and the closure plate are formed as a single piece of plastic via an injection molding process. However, it should also be noted that other production methods may be utilized without departing from the scope of the invention.

In operation, the strap of the undergarment is placed between the anchor plate 54 and the closure plate 32 before the closure plate is secured to the anchor plate with the catch. The strap 14 of the outer garment 12 is positioned over the magnet 26, and a base plate 102 is secured to the magnet to finish the assembly. Various decorations (not shown) may be secured to the base plate as desired.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A shoulder strap retainer for garments comprising:

an anchor assembly for positioning a strap of a garment, said anchor assembly including an anchor plate, said anchor plate including an upper surface and a lower surface, said anchor plate having a pair of magnets secured to said upper surface thereof, said magnets arranged in a spaced apart relationship with respect to each other, whereby said spacing is sufficient to accept said strap of a first garment a closure plate having a first end and a second end, said first end hingedly secured to said lower surface of said anchor plate for movement between an open position and a closed position, said closure plate constructed and arranged to cooperate with the strap portion of said first garment, whereby said strap is secured between said closure plate and said lower surface of said anchor plate;

a latch for releasably securing said second end of said closure plate to said anchor plate;

a base plate, said base plate being constructed at least partially from a material that is attracted to a magnetic field, said base plate having a bottom surface constructed and arranged to be positioned adjacent an outer surface of a second garment, whereby said base plate is attracted to said pair of magnets to secure said second garment in a fixed position with respect to said first garment.

2. The shoulder strap retainer for garments of claim 1 wherein said base plate includes a top surface, said top surface including at least one decoration thereon.

3. The shoulder strap retainer for garments of claim 1 wherein said anchor plate and said closure plate are formed as a single plastic component.

4. The shoulder strap retainer for garments of claim 3 wherein said hinged connection is a living hinge.

5. The shoulder strap retainer for garments of claim 1 wherein said lower surface of said anchor plate includes gripping teeth.

6. The shoulder strap retainer for garments of claim 1 wherein said latch includes a deformable member having an outwardly extending catch, said catch including a ramping surface and a catch surface, whereby said ramping surface deflects said deformable member until said catch surface catches on a surface.

7. The shoulder strap retainer for garments of claim 6 wherein said anchor plate includes an aperture sized for passage of said deformable member, whereby said catch surface catches upon said upper surface of said anchor plate.

8. A shoulder strap retainer for garments comprising:

an anchor assembly for positioning a strap of a garment, said anchor assembly including an anchor plate, said anchor plate including an upper surface and a lower surface, said upper surface including at least two magnets positioned in a spaced apart relationship with respect to each other, said magnets spaced sufficiently apart to accept the strap portion of a first garment, whereby said first garment is secured in said anchor assembly;

a base plate having sufficient length to cooperate with said at least two magnets, said base plate being constructed at least partially from a material that is attracted to a magnetic field, said base plate having a bottom surface constructed and arranged to be positioned adjacent an outer surface of a second garment, whereby said base plate is attracted to said at least two magnets to secure said second garment in a fixed position with respect to said first garment, whereby said first garment is free to move a limited amount with respect to said second garment while said first garment strap remains hidden behind said second garment.

9. The shoulder strap retainer for garments of claim 8 wherein said anchor plate is constructed from an elastic material.

10. The shoulder strap retainer for garments of claim 8 wherein said anchor plate is constructed as a magnet.

11. The shoulder strap retainer for garments of claim 8 wherein said anchor plate is constructed of two members, whereby one member is slidably received within the other, one of said magnets being secured to each of said two members, whereby said spacing between said magnets can be altered by sliding one member with respect to the other.

12. The shoulder strap retainer for garments of claim 8 wherein said anchor plate includes a plurality of apertures extending along the length thereof, said apertures sized to frictionally cooperate with a pin extending outwardly from a bottom surface of each said magnet, whereby said magnets may be positioned as desired along said length of said anchor plate by pushing said pin into a desired aperture.

13. The shoulder strap retainer for garments of claim 12 wherein said apertures are indentions that do not extend through said anchor plate.

14. The shoulder strap retainer for garments of claim 8 wherein said anchor plate includes a channel extending along the length of the anchor plate and positioned between said upper and said lower surfaces, said channel sized such that it enables a strap of an undergarment to be placed within said channel.

15. The shoulder strap retainer for garments of claim 14 wherein said anchor plate includes a slot extending downward from said upper surface to said channel, said slot sized such that it enables a strap of an undergarment to be placed within said channel.

16. The shoulder strap retainer for garments of claim 8 wherein said base plate includes an upper surface, said upper surface including a pair of magnets in a spaced apart relationship, a base plate hingedly secured to one of said spaced apart magnets for movement between an open and a closed position, said base plate constructed at least partially from a magnetically influenced material, whereby a portion of said second garment may be placed between said spaced apart magnets and said base plate is magnetically attracted to said magnets to secure said portion of said second garment.

* * * * *